US005580516A

United States Patent [19]

Kumar

[11] Patent Number: 5,580,516

[45] Date of Patent: Dec. 3, 1996

[54] POWDERS AND PRODUCTS OF TANTALUM, NIOBIUM AND THEIR ALLOYS

[75] Inventor: Prabhat Kumar, Allentown, Pa.

[73] Assignee: Cabot Corporation, Boston, Mass.

[21] Appl. No.: 475,018

[22] Filed: Jun. 7, 1995

Related U.S. Application Data

[62] Division of Ser. No. 198,457, Feb. 18, 1994, abandoned, which is a continuation of Ser. No. 880,144, Jun. 19, 1992, abandoned, which is a division of Ser. No. 626,610, Dec. 12, 1990, Pat. No. 5,242,481, which is a division of Ser. No. 371,618, Jun. 26, 1989, abandoned.

[51] Int. Cl.[6] ..... B22F 1/00

[52] U.S. Cl. ..... 419/1; 419/53; 419/54; 419/55; 419/56; 419/58; 419/60

[58] Field of Search ..... 419/1, 53, 54, 419/55, 56, 58, 60

[56] References Cited

U.S. PATENT DOCUMENTS

| | | | |
|---|---|---|---|
| Re. 32,260 | 10/1986 | Fry . | |
| 3,295,451 | 1/1967 | Fincham et al. . | |
| 3,384,479 | 5/1968 | Chang . | |
| 3,489,538 | 1/1970 | Cook . | |
| 3,497,402 | 2/1970 | Douglass et al. . | |
| 3,697,255 | 10/1972 | Baldwin et al. | 75/.5 AB |
| 3,791,821 | 2/1974 | Buckman, Jr. . | |
| 3,997,341 | 12/1976 | Janowski et al. . | |
| 4,041,138 | 8/1977 | Glaeser et al. . | |
| 4,062,679 | 12/1977 | Marsh et al. . | |
| 4,126,493 | 11/1978 | Wurm . | |
| 4,141,719 | 2/1979 | Hakko . | |
| 4,141,720 | 2/1979 | Vartanian . | |
| 4,423,004 | 12/1983 | Ross . | |
| 4,441,927 | 4/1984 | Getz et al. . | |
| 4,483,819 | 11/1984 | Albrecht et al. . | |
| 4,508,563 | 4/1985 | Bernard et al. . | |
| 4,544,403 | 10/1985 | Schiele et al. . | |
| 4,722,756 | 2/1988 | Hard | 148/126.1 |
| 4,762,557 | 8/1988 | Nagaraian et al. . | |
| 4,859,257 | 8/1989 | Bates et al. . | |
| 4,923,531 | 5/1990 | Fisher . | |
| 4,954,169 | 9/1990 | Behrens | 75/228 |
| 4,960,471 | 10/1990 | Fife et al. . | |
| 4,964,906 | 10/1990 | Fife . | |
| 4,964,908 | 10/1990 | Greetham | 75/241 |
| 4,968,481 | 11/1990 | Rerat . | |
| 5,082,491 | 1/1992 | Rerat . | |
| 5,242,481 | 9/1993 | Kumar | 75/364 |

FOREIGN PATENT DOCUMENTS

| | | |
|---|---|---|
| 236694 | 4/1959 | Australia . |
| 0388957 | 3/1990 | European Pat. Off. . |
| 3130392 | 7/1981 | Germany . |
| 39-19962 | 9/1964 | Japan . |
| 71-20953 | 6/1971 | Japan . |
| 63383733 | 12/1972 | Japan . |
| 85-225901/37 | 9/1984 | Japan . |
| 62-103335 | 5/1987 | Japan . |
| 63-198816613 | 1/1988 | Japan . |
| 870930 | 6/1961 | United Kingdom . |
| 881997 | 11/1961 | United Kingdom . |
| 1171790 | 12/1969 | United Kingdom . |
| 1266065 | 3/1972 | United Kingdom . |
| 2138447 | 10/1984 | United Kingdom . |
| 2185756 | 7/1987 | United Kingdom . |

OTHER PUBLICATIONS

Influence of Initial Ingot Breakdown on the Microstructural and Textural Development of High–Purity Tantalum, J. B. Clark et al., Metallurgical Transactions A. vol. 22A, Dec. 1991, pp. 2959–2967.

*Primary Examiner*—Charles T. Jordan
*Assistant Examiner*—Anthony R. Chi
*Attorney, Agent, or Firm*—Thomas E. Kelley; Martha A. Finnegan

[57] ABSTRACT

A powder of tantalum, niobium, or an alloy thereof, having an oxygen content less than about 300 ppm, and the production thereof without exposure to a temperature greater than about 0.7 $T_H$. A powder metallurgy formed product of tantalum, niobium, or an alloy thereof, having an oxygen content less than about 300 ppm, and the production thereof without exposure to a temperature greater than about 0.7 $T_H$.

12 Claims, No Drawings

POWDERS AND PRODUCTS OF TANTALUM, NIOBIUM AND THEIR ALLOYS

This application is a divisional application of application Ser. No. 08/198,457, filed Feb. 18, 1994, entitled POWDERS AND PRODUCTS OF TANTALUM, NIOBIUM AND THEIR ALLOYS now abandoned, which is a continuation of Ser. No. 07/880,144, filed Jun. 19, 1992 now abandoned, which is a divisional of Ser. No. 07/626,610, filed Dec. 12, 1990, (now U.S. Pat. No. 5,242,481, issued Sep. 7, 1993), which is a divisional of Ser. No. 07/371,618, filed Jun. 26, 1989 (now abandoned).

FIELD OF THE INVENTION

The present invention relates to powders and products of tantalum, niobium, and their alloys having low oxygen contents, and processes for producing same.

BACKGROUND

Tantalum, and niobium are generally extracted from their ores in the form of powders. For example, tantalum is generally produced by reducing potassium fluorotantalate ($K_2TaF_7$) by chemical reaction with sodium. This reduction reaction generally produces a salt-encapsulated metal powder which is crushed and washed, with water and acid, to produce tantalum powder.

Tantalum and niobium metals, and their alloys, are then consolidated to form products. The method chosen for consolidation depends upon whether the resulting consolidated product will be pure metal or an alloy, what form or shape is required, and how the material is to be used. Tantalum, niobium, and their alloys are generally used to form wrought products, such as bars, plates, sheets, wire, tubes and rods; preforms, for subsequent thermo-mechanical processing; and near net shapes, for use, in a variety of applications, after machining and finishing.

Tantalum, niobium and their alloys generally have a high affinity for oxygen. Thus the oxygen content of products of niobium, tantalum, or their alloys tends to increase during their formation. The oxygen content of the product affects its mechanical properties and fabricability. Generally, as the oxygen content of the product increases, the product's ductility decreases and the product's strength increases. For many applications utilizing products of tantalum, niobium, or their alloys, a high oxygen content is unsuitable. Therefore, to produce tantalum, niobium, or alloy products suitable for these applications, a low oxygen content must be obtained.

There are several methods which may be utilized to produce formed products of tantalum, niobium or their alloys. For example, in one method the metal is first melted by electron beam or vacuum arc melting, in a vacuum, and then thermo-mechanically processed to form the product. The melting temperature is also referred to as the homologous temperature ($T_H$) in degrees Kelvin. $T_H$ for tantalum is 3273 degrees K and $T_H$ for niobium is 2745 degrees K. The melting in a vacuum reduces the oxygen content of the metal.

In a second method the metal, in powder form, is first cold isostatically pressed into a tantalum, niobium or alloy preform, such as a bar or rod, and then the preform is resistance sintered at a temperature greater than 0.7 $T_H$ to produce a formed product of tantalum, niobium or their alloys. Generally, for resistance sintering, the ends of the preform are clamped between water cooled copper terminals in a high vacuum chamber and then the preform is heated, to a temperature above 0.7 $T_H$, by passing an electrical current through the preform. The resistance sintering simultaneously densifies and lowers the oxygen content of the preform.

However, there are many disadvantages in utilizing resistance sintering to densify and remove oxygen. First, resistance sintering may only be utilized to produce products of certain limited shapes, generally bars or rods. For resistance sintering, the cross-section of the preform must be uniform along the path of electrical current in order to prevent localized overheating and hot-shorting. Additionally, the cross section must be small enough so that the oxygen reduction in the center of the preform occurs before the disappearance of the interconnected porosity. For effective oxygen removal, preforms greater than about 1.5 inches in their shortest dimension are not resistance-sintered. Still further the preform must be small enough to prevent sagging associated with creep and hot pressing during unsupported resistance sintering. Thus, the preforms generally do not weigh greater than about 40 lbs.

A third method for producing formed products of tantalum, niobium, or their alloys, is the rotating electrode process. In this process a bar or rod of the metal is heated to a temperature above $T_H$. The molten metal is converted into powder by centrifugal force. The low oxygen content of the starting rod is maintained in the powder, however the powder particles are relatively spherical and generally coarser than the initial chemically produced powders. These relatively spherical powder particles are not desirable for unidirectional mechanical pressing. Further, the coarseness of the powder particles makes the powder undesirable for cold-isostatic pressing into formed tantalum, niobium or alloy products.

SUMMARY OF THE INVENTION

I have discovered new powders of tantalum, niobium or alloys of tantalum or niobium having an oxygen content of less than about 300 ppm. I have also discovered a method for producing these powders wherein tantalum, niobium or alloy powders are heated in the presence of an oxygen-active metal, such as magnesium, at a temperature less than about 0.7 $T_H$.

I have further discovered formed powder metal products having oxygen contents less than about 300 ppm formed from tantalum, niobium, and their alloys. I have still further discovered a new process for producing formed powder metal products of tantalum, niobium and their alloys, having oxygen contents below about 300 ppm, which is carried out without exposing the metal to a temperature greater than about 0.7 $T_H$.

According to the present invention, tantalum, niobium, or alloys of tantalum or niobium, powders, having oxygen contents less than about 300 ppm are produced by heating a tantalum, niobium, or alloy powder to a temperature lower than about 0.7 $T_H$ in the presence of an oxygen active metal for a period of time sufficient to lower the oxygen content of the starting powder to less than about 300 ppm. Furthermore, according to the present invention, formed products of tantalum, niobium and their alloys, having oxygen contents less than about 300 ppm are produced by consolidating a tantalum, niobium, or alloy powder, having an oxygen content of less than about 300 ppm, without exposing the metal to a temperature greater than about 0.7 $T_H$. If the starting metal powder has an oxygen content greater than about 300 ppm, then the powder must first be deoxidized to a level of less than 300 ppm, such as by the technique described above. For tantalum powder, 0.7 $T_H$ equals about 2018 degrees C. (2291 degrees K) and for niobium powder, 0.7 $T_H$ equals about 1650 degrees C. (1923 degrees K).

An advantage of the powder of the present invention is that it comprises relatively non-spherical particles well suited for unidirectional mechanical pressing.

A further advantage of the powder of the present invention is that it comprises relatively small particles well suited for cold-isostatic-pressing.

An advantage of the formed products of tantalum, niobium or their alloys, of the present invention, having oxygen contents less than about 300 ppm, is that the products can be of any shape, cross-section or size.

An advantage of the process for producing formed products of the present invention is that the process allows for the production of tantalum, niobium, or alloy products having an oxygen content less than about 300 ppm, of any shape, cross-section or size.

DETAILED DESCRIPTION OF THE INVENTION

The tantalum, niobium, or alloy of tantalum or niobium powders, having an oxygen content below about 300 ppm (parts per million), of the present invention, are produced by the following procedure. A tantalum, niobium or alloy powder, such as one produced by a sodium reduction process, is placed into a vacuum chamber which also contains a metal having a higher affinity for oxygen than the powder. Preferably, the starting powder has an oxygen content less than about 1000 ppm. One such metal, more oxygen active than the powder, is magnesium. The chamber is then heated, to a temperature not greater than about 0.7 $T_H$, to produce a powder of tantalum, niobium or alloy of tantalum or niobium having an oxygen content less than about 300 ppm. The heating is continued for a time sufficient to allow oxygen to diffuse out of the metal powder and yield a metal powder having less than about 300 ppm oxygen. The magnesium, containing the oxygen, is then removed from the metal powder by evaporation, and subsequently by selective chemical leaching or dissolution of the powder.

The alloys of tantalum or niobium of the present invention include alloys of tantalum and/or niobium and an oxide which has a higher free energy of formation than tantalum oxide, such as for example yttrium oxide, thorium oxide, or aluminum oxide. The oxide is blended into the tantalum and/or niobium powder having an oxygen content of less than about 300 ppm. The alloys of the present invention also include alloys of tantalum and/or niobium and an alloying element with a low oxygen content blended into the tantalum or niobium powder, provided that the oxygen content of the blend is less than about 300 ppm. The alloys of the present invention further include alloys of tantalum and/or niobium and an alloying element wherein the alloying element and the tantalum and/or niobium powder are blended prior to deoxidation to form the alloy having an oxygen content less than about 300 ppm. The alloys of the present invention still further include alloys of tantalum and/or niobium and an alloying element wherein the oxygen addition associated with the alloying element does not raise the oxygen content of the alloy above 300 ppm.

As described above, in the process for producing formed powder metal products of tantalum, niobium and their alloys, a tantalum, niobium, or alloy of tantalum or niobium, powder is, if needed, deoxidized, to an oxygen content of less than about 300 ppm, without exposing the powder to a temperature greater than about 0.7 $T_H$, and then the powder is consolidated, without exposing the powder to a temperature greater than about 0.7 $T_H$, to form a tantalum, niobium, or alloy product, having an oxygen content below about 300 ppm, preferably between about 100 and about 300 ppm.

According to the present invention, a formed tantalum, niobium or alloy product, having an oxygen content below about 300 ppm, may be produced from powder, having an oxygen content below about 300 ppm, by any known powder metallurgy technique, utilized for tantalum, niobium and their alloys, provided that the metal is not exposed to a temperature greater than about 0.7 $T_H$. Exemplary of these powder metallurgy techniques used for forming the metal products are the following, in which the steps are listed in order of performance. Any of the techniques may be utilized in the present invention, provided that any sintering, heating, or other handling, of the metal does not expose the metal to a temperature greater than 0.7 $T_H$:

1. Cold Isostatic Pressing, Sintering, Encapsulating, Hot Isostatic Pressing and Thermo-Mechanical Processing;
2. Cold Isostatic Pressing, Sintering, Hot Isostatic Pressing and Thermo-Mechanical Processing;
3. Cold Isostatic Pressing, Encapsulating, Hot Isostatic Pressing and Thermo-Mechanical Processing;
4. Cold Isostatic Pressing, Encapsulating and Hot Isostatic Pressing;
5. Encapsulating and Hot Isostatic Pressing;
6. Cold Isostatic Pressing, Sintering, Encapsulating, Extruding and Thermo-Mechanical Processing;
7. Cold Isostatic Pressing, Sintering, Extruding, and Thermo-Mechanical Processing;
8. Cold Isostatic Pressing, Sintering, and Extruding;
9. Cold Isostatic Pressing, Encapsulating, Extruding and Thermo-Mechanical Processing;
10. Cold Isostatic Pressing, Encapsulating and Extruding;
11. Encapsulating and Extruding;
12. Mechanical Pressing, Sintering and Extruding;
13. Cold Isostatic Pressing, Sintering, Encapsulating, Forging and Thermo-Mechanical Processing.
14. Cold Isostatic Pressing, Encapsulating, Forging and Thermo-Mechanical Processing;
15. Cold Isostatic Pressing, Encapsulating and Forging;
16. Cold Isostatic Pressing, Sintering, and Forging;
17. Cold Isostatic Pressing, Sintering and Rolling;
18. Encapsulating and Forging;
19. Encapsulating and Rolling;
20. Cold Isostatic Pressing, Sintering and Thermo-Mechanical Processing;
21. Spray Depositing;
22. Mechanical Pressing and Sintering; and
23. Mechanical Pressing, Sintering, Repressing and Resintering.

Other combinations of consolidating, heating and deforming may also be utilized.

The effectiveness and advantages of the products and processes of the present invention will be further illustrated by the following examples which are intended to be illustrative in nature and are not to be construed as limiting the scope of the invention.

EXAMPLES

The following analytical test procedures were utilized to determine the properties of the powders and formed products of the present invention:

Carbon Content

Carbon content of the tantalum, niobium or alloy powder was determined by a gas method, using a Leco 1R-12 Carbon Determinator, Leco #528-035 Crucibles, Leco #501-263 Copper Metal Accelerator, and Leco #501-507 Carbon Standards (0.0066+0.0004% C), manufactured by LECO Corporation, 3000 Lakeview Avenue, St. Joseph, Mich. 49805. The crucibles were placed in a muffle furnace and ignited at 1000 degrees C. for 1 hour and then allowed to cool and stored in a clean desiccator. A 1.0 gram sample of tantalum, niobium, or alloy powder was then transferred to a crucible. The tantalum, niobium, or alloy powder in the crucible was then covered with approximately 1 gram of copper metal accelerator. Several crucibles containing only one scoop of copper metal accelerator, and several crucibles containing 1 gram of carbon standard and 1 gram of copper metal accelerator were also prepared, for instrument calibration, as blank samples and standard samples respectively. To calibrate the Carbon Determinator successive blanks were analyzed and the carbon determinator Digital Voltmeter (DVM) reading was adjusted to show 0.000000% carbon. Next successive standard samples were analyzed and the carbon determinator DVM reading was adjusted to show 0.0066+0.0004% carbon. After calibration the crucible containing the tantalum, niobium or alloy powder, covered with copper metal accelerator was analyzed. The carbon determinator DVM reading for the tantalum, niobium or alloy sample equaled the carbon content in parts per million.

Nitrogen and Oxygen Content

The Nitrogen and Oxygen content of the tantalum, niobium or alloy powder were determined using a Leco TC-30 Oxygen Nitrogen Analyzer, Leco #760-414 Graphite Crucibles, manufactured and sold by Leco Corporation, 3000 Lakeview Avenue, St. Joseph, Mich. 49805 and 2 inches wide by 0.025 inch thick nickel foil. The nickel foil was, cut into 1 inch by 1 inch squares, cleaned and formed into capsules. 0.2 grams of a sample were transferred to each capsule and the capsule was closed and crimped into the smallest possible volume. The Leco TC-30 Oxygen Nitrogen Analyzer, was first calibrated using blank and tantalum standards of known oxygen and nitrogen content, in a manner similar to the manner described above for calibrating the carbon determinator, and then the samples were run through the analyzer to generate ppm oxygen and ppm nitrogen.

The following properties were determined in accordance with the ASTM Test method shown in the following chart:

| Property | ASTM Test Method |
|---|---|
| Particle Size | B-214 |
| Pressed Density | B-212 |
| Grain Size | E-112 |
| Transverse Rupture Strength | B-528 |
| Powder Flow Rate | B-213 |
| B.E.T. Surface Area | C-699 |
| Yield Strength | E-8 |
| Tensile Strength | E-8 |
| % Elongation | E-8 |

Density of Formed Product

The density of the formed product was calculated by measuring the weight and the dimensions, height, width etc. of the product. From the dimensions, the volume of the product was calculated in cubic centimeters. Density was then calculated by dividing the weight of the product by the volume of the product.

Percentage (%) of Theoretical Density

The percentage of theoretical density of the product was calculated by dividing the density of the product by the theoretical density of the metal, for example 16.6 grams/cubic centimeter for Tantalum.

EXAMPLE 1

Example 1 illustrates the production of a tantalum powder having an oxygen content less than about 300 ppm. A starting tantalum powder having an oxygen content of about 600 ppm, a carbon content of about 40 ppm, and a nitrogen content of less than 10 ppm, was blended with an amount of about 1% by weight magnesium. The resulting blend was heated at 850 degrees C. (0.34 $T_H$) for 2 hours. The magnesium, not reacted with the oxygen, was then removed by further heating the blend to 1000 degrees C. (0.38 $T_H$) at a pressure of 0.001 Torr. Any remaining magnesium was removed by immersing the powder in nitric acid at room temperature. The powder was then washed in water and air dried. The resulting tantalum powder had an oxygen content of 185 ppm, a carbon content of 45 ppm, and a nitrogen content of 45 ppm. The resulting tantalum powder also had an apparent density of 4.12 gm/cc and a flow rate of 26 seconds for 50 grams. The particle size distribution was as shown below:

| Particle Size | wt. % |
|---|---|
| 40/60 | 0.1% |
| 60/100 | 56% |
| 100/200 | 37.8% |
| 200/325 | 2.4% |
| 325 | 3.7%. |

EXAMPLE 2

Example 2 illustrates a formed product of tantalum, having an oxygen content of about 205 ppm, produced by mechanical pressing and sintering.

A deoxidized tantalum powder having a carbon content of about 60 ppm, an oxygen content of about 135 ppm, and a nitrogen content of about 10 ppm, prepared by a procedure similar to the procedure of Example 1, was utilized as the starting powder. This tantalum powder was placed in a die and pressed, using uniaxial pressure, into a 4 inch diameter tablet with a pressed density of about 80% of the theoretical density. This tablet was then sintered at 1500 degrees C. (0.54 $T_H$) for 2 hours in a vacuum evacuated to less than about 0.001 Torr. The final sintered tablet had a carbon content of about 60 ppm, an oxygen content of about 205 ppm and nitrogen content of about 10 ppm.

EXAMPLE 3

The following tests were conducted to show that the tantalum, niobium or alloy powder, of the present invention, is compressible, and to show the strength of the powder of the present invention.

A deoxidized tantalum powder having a carbon content of about 60 ppm, an oxygen content of about 135 ppm, and a nitrogen content of about 10 ppm, prepared by a procedure similar to the procedure of Example 1, was utilized as the starting powder. The starting powder was placed in a die and pressed at various pressures, into tablets, 1 inch in diameter, and about ½ inch in height. The density of the tablets as a function of the Pressing pressures was as follows:

| Pressure (1000 lbs/sq. in.) | Density (% of theoretical) |
|---|---|
| 35,000 | 75.5 |
| 40,000 | 78 |
| 45,000 | 80 |
| 50,000 | 82.1 |
| 55,000 | 83.6 |
| 60,000 | 85.1 |
| 65,000 | 86.4 |
| 70,000 | 87.5 |
| 80,000 | 89.7 |
| 100,000 | 92.6 |

These results show that the powders of the present invention are compressible.

To show the strength of the powder of the present invention after mechanical pressing, a deoxidized tantalum powder having a carbon content of about 60 ppm, an oxygen content of about 135 ppm, and a nitrogen content of about 10 ppm, prepared by a procedure similar to the procedure of Example 1, was placed in a die and pressed, at various pressures, into bars about ½ inch by about ½ inch, by about 2 inches. The transverse rupture strength of these bars was as follows:

| Pressure (lbs./sq. in.) | Tranverse Rupture Strength (lbs./sq. in.) |
|---|---|
| 20,000 | 1100 |
| 30,000 | 1940 |
| 37,000 | 2720 |
| 60,000 | 7700 |

Generally a minimum strength of about 2000 lbs./sq.in. is desired for normal handling of pressed compacts. The data from the compressibility test together with the rupture strength test indicates that this strength level can be obtained with the powder of the present invention formed at a pressure somewhat in excess of 30,000 psi, where the pressed compact has a density of about 75% of the theoretical.

EXAMPLE 4

Example 4 illustrates the production of a formed tantalum product having an oxygen content of about 130 ppm without exposing the metal to a temperature greater than 0.7 $T_H$, by cold isostatic pressing (CIP), followed by hot isostatic pressing (HIP) and finally followed by thermo-mechanical processing (TMP).

A deoxidized tantalum powder having a carbon content of about 10 ppm, an oxygen content of about 155 ppm, and a nitrogen content of about 15 ppm, prepared by a procedure similar to the procedure of Example 1, was utilized as the starting powder. This powder was cold isostatically pressed at 60,000 lbs./sq.in. and room temperature, into a preform of about 5.0 inches by about 10.3 inches by about 1.6 inches with a weight of about 50 pounds. This preform was hermetically encapsulated then hot isostatically pressed at 42,000 lbs./sq.in., and 1300 degrees C. (0.48 $T_H$) for 4 hours into a preform of about 4.75 inches by about 10.2 inches by about 1.45 inches. The hot isostatically pressed preform had a carbon content of about 45 ppm, an oxygen content of about 130 ppm and a nitrogen content of less than about 10 ppm.

The hot isostatically pressed preform was then annealed at 1300 degrees C. (0.48 $T_H$) for 2 hours in a vacuum evacuated to less than about 0.001 Torr and then the encapsulation was removed. The resultant preform was rolled to a thickness (t) of about 0.4 inch. Then the rolled preform was annealed at 1300 degrees C. (0.48 $T_H$) for 2 hours in a vacuum evacuated to less than about 0.001 Torr. Next the preform was rerolled to a thickness (t) of about 0.08 inch. Then the rerolled preform was annealed at 1300 degrees C. (0.48 $T_H$) for 2 hours in a vacuum evacuated to less than about 0.001 Torr. Next the preform was rolled to a thickness (t) of about 0.015 inch. Then the three times rolled preform was annealed at 1300 degrees C. (0.48 $T_H$) for 2 hours in a vacuum evacuated to less than about 0.001 Torr. Samples of the preform at various thickness were taken during process herein described. The mechanical properties of the preform at the various thicknesses, in annealed condition, were as follows:

| Condition | Yield Strength (lbs./sq. in.) | Tensile Strength (lbs./sq. in.) | Elongation (%) | Grain size |
|---|---|---|---|---|
| As HIPed | 34,800 | 52,700 | 48 | 7 |
| t = 0.25 in. | 39,300 | 48,400 | 47 | — |
| t = 0.08 in. | 42,600 | 51,300 | 41 | — |
| t = 0.03 in. | 43,700 | 54,000 | 40 | — |
| t = 0.015 in. | 40,800 | 51,100 | 40 | 8 |

These properties are comparable to properties of tantalum sheet produced by sintering at a temperature greater than about 0.7 $T_H$, which indicates that the powders and formed products of the present invention are suitable for use in the same applications as products produced by sintering at a temperature greater than about 0.7 $T_H$.

EXAMPLE 5

Example 5 illustrates the production of a formed tantalum product having an oxygen content of about 140 ppm, a carbon content of 30 ppm, and a nitrogen content of 15 ppm, without exposing the metal to a temperature greater than 0.7 $T_H$ by cold isostatic pressing, sintering and then thermo-mechanical processing.

A deoxidized tantalum powder having a carbon content of about 10 ppm, an oxygen content of about 155 ppm, and a nitrogen content of about 15 ppm, prepared by a procedure similar to the procedure of Example 1, was utilized as the starting powder. This powder was Cold Isostatically pressed at 60,000 lbs./sq.in. into a bar shaped preform of about 0.63 inch by about 2.5 inches by about 25 inches weighing about 25 pounds. This preform was sintered at 1500 degrees C. (0.53 $T_H$) for 2 hours in a vacuum evacuated to less than about 0.001 Torr, to yield a preform having a density of about 95% of the theoretical density. The preform was then rolled to a thickness (t) of about 0.2 inch and a width of about 6 inches and a length of about 30 inches. Then the rolled preform was annealed at 1300 degrees C. (0.48 $T_H$) for 2 hours in a vacuum evacuated to less than about 0.001 Torr. The formed sheet had a carbon content of 30 ppm, an oxygen content of 140 ppm, and a nitrogen content of 15 ppm. The density of the sheet was 100% of the theoretical density and the grain size was 8.5. The longitudinal axis of the sheet had a yield strength of 54,700 lbs./sq.in., a tensile strength of 40,000 lbs./sq.in. and 45% elongation. The transverse axis of the sheet had a yield strength of 54,100 lbs./sq.in., a tensile strength of 36,600 lbs./sq.in. and 46% elongation. These results indicate that the sheet is suitable for use in the same applications as sheets produced by exposing tantalum to a temperature greater than about 0.7 $T_H$.

EXAMPLE 6

Example 6 illustrates the production of a formed tantalum product having an oxygen content of about 205 ppm, a carbon content of 60 ppm, and a nitrogen content of 10 ppm, prepared without exposing the metal to temperature greater than 0.7 $T_H$ by mechanical pressing, sintering, repressing and resintering.

A deoxidized tantalum powder having a carbon content of about 60 ppm, an oxygen content of about 135 ppm, and a nitrogen content of about 10 ppm, prepared by a procedure similar to the procedure of Example 1, was utilized as the starting powder. This tantalum powder was placed in a die and mechanically pressed, using uniaxial pressure, into a tablet, 0.3 inch diameter by 0.14 inch high. This tablet was then sintered at 1450 degrees C. (0.53 $T_H$) for 2 hours in a vacuum evacuated to less than about 0.001 Torr. The final sintered tablet had a carbon content of about 60 ppm, an oxygen content of about 205 ppm and a nitrogen content of about 10 ppm.

The sintered tablet was then repressed into a preform. The preform was then resintered at 1450 degree C. (0.53 $T_H$) for 2 hours in a vacuum evacuated to less than about 0.001 Torr. The resulting resintered preform was suitable for extruding to produce a formed tantalum product.

EXAMPLE 7

Example 7 illustrates the production of a formed tantalum product having an oxygen content of about 165 ppm, a carbon content of 90 ppm, and a nitrogen content of 10 ppm, prepared without exposing the metal to a temperature greater than 0.7 $T_H$ by cold isostatic pressing, encapsulating and then extruding.

A deoxidized tantalum powder having a carbon content of about 80 ppm, an oxygen content of about 155 ppm, and a nitrogen content of less than about 10 ppm, prepared by a procedure similar to the procedure of Example 1, was utilized as the starting powder. This tantalum powder was Cold Isostatically pressed at 60,000 lbs./sq.in. into a rod shaped preform of about 2 inches in diameter by about 5 inches long. The rod shaped preform was then hermetically encapsulated in a steel container and extruded at 1150 degrees C. (0.43 $T_H$) through a ⅝ inch diameter die. The Encapsulating steel container was then removed and the preform was annealed at 1300 degrees C. (0.48 $T_H$) for 2 hours in a vacuum evacuated to less than about 0.001 Torr. The annealed preform had a carbon content of about 90 ppm, an oxygen content of about 165 ppm, a nitrogen content of less than about 10 ppm, a yield strength of 41,600 lbs./sq.in., a tensile strength of 60,300 lbs./sq.in. and an elongation of 52%. The annealed preform had a grain size of 12.5 microns.

The properties of the annealed preform indicate that the annealed preform is suitable for subsequent thermo-mechanical processing.

EXAMPLE 8

Example 8 illustrates the production of a formed tantalum product having oxygen content of about 155 ppm, prepared without exposing the metal to a temperature greater than 0.7 $T_H$, by spray deposition.

A deoxidized tantalum powder having a carbon content of about 80 ppm, an oxygen content of about 155 ppm, and a nitrogen content of less than about 10 ppm, prepared by a procedure similar to the procedure of Example 1, was utilized as the starting powder. The powder was spray deposited up to a thickness of 0.01 inch on an alloy substrate formed from Hastelloy Alloy X (Hastelloy is a trademark for alloys produced and sold by Haynes Corporation, Park Avenue, Kokomo, Ind.). No problems were encountered, indicating that the particle size, flow properties and oxygen content of the powder of the present invention are suitable for consolidation by spray deposition.

EXAMPLE 9

Example 9 illustrates the production of a niobium powder having an oxygen content of 175 ppm. The starting niobium powder having an oxygen content of about 660 ppm, a carbon content of about 25 ppm, and a nitrogen content of about 70 ppm, was blended with an amount of about 1.5% by weight magnesium. The resulting blend was heated at 850 degrees C. (0.34 $T_H$) for 2 hours in an Argon atmosphere. The magnesium, not reacted with the oxygen, was then removed by further heating the blend to 850 degrees C. (0.34 $T_H$) at a pressure of 0.001 Torr. Any remaining magnesium was removed by immersing the powder in nitric acid at room temperature. The powder was then washed with water and air dried. The resulting niobium powder had an oxygen content of 175 ppm, a carbon content of 20 ppm, and a nitrogen content of 55 ppm. The resulting niobium powder also had an apparent density of 3.45 gm/cc and a flow rate of 22 seconds for 50 grams. The particle size distribution was as shown below:

| Particle Size | wt. % |
|---|---|
| 60/100 | — |
| 100/200 | 74% |
| 200/325 | 23% |
| 325/500 | 2% |
| −500 | 1% |

Numerous variations and modifications may obviously be made without departing from the present invention. Accordingly, it should be clearly understood that the forms of the present invention herein described are illustrative only and are not intended to limit the scope of the invention. The present invention includes all modifications falling

I claim:

1. A process for producing formed powder metallurgy products, comprising:

providing a metal powder having an oxygen content greater than 300 ppm, said metal powder comprising a metal selected from the group consisting of tantalum, niobium, an alloy of tantalum, and an alloy of niobium;

heating said metal powder to a temperature not exceeding $0.7T_H$ of the metal in the presence of a metal having a higher affinity for oxygen;

removing the metal having a higher affinity for oxygen from the metal, to form a metal powder with an oxygen content less than 300 ppm; and forming a metallurgical product from said metal powder with an oxygen content less than 300 ppm, without exposing said metal to a temperature greater than about $0.7T_H$ of the metal.

2. The process of claim 1, wherein said metal product is formed by compressing said metal powder to about 75 to 92% of theoretical density with compressive forces of between about 35,000 to about 100,000 psig.

3. The process of claim 1, wherein said metal product has a transverse rupture strength of between about 1,100 to about 7,700 psi when compressed with a pressure of between 20,000 to about 60,000 psi.

4. The process of claim 1, wherein said powder comprises non-spherical particles.

5. The process of claim 1, wherein said heating is performed under vacuum.

6. The process of claim 1, wherein said active metal is magnesium.

7. The process of claim 1, wherein said magnesium is removed by evaporation and chemical leaching.

8. The process of claim 1, wherein the metal is tantalum.

9. The process of claim 1, wherein the metal is niobium.

10. The process of claim 1, wherein the metal is an alloy of tantalum.

11. The process of claim 1, wherein the metal is an alloy of niobium.

12. A process for producing formed powder metallurgy products, comprising:

providing a metal powder having an oxygen content greater than 300 ppm said metal powder comprising a metal selected from the group consisting of tantalum, niobium, an alloy of tantalum, and an alloy of niobium;

heating said metal powder to a temperature not exceeding $0.7T_H$ of the metal in the presence of a metal having a higher affinity for oxygen;

removing the metal having a higher affinity for oxygen from the metal, to form a metal powder with an oxygen content less than 300 ppm; and forming a metallurgy product from said metal powder with an oxygen content less than 300 ppm, without exposing said metal to a temperature greater than about $0.7T_H$ of the metal, by compressing said metal power to about 75 to 92% of the theoretical density with compressive forces of between about 35,000 to about 100,000 psig.

* * * * *